United States Patent [19]

Sulser et al.

[11] 4,354,534

[45] Oct. 19, 1982

[54] REED FOR JET LOOMS

[75] Inventors: Heinrich Sulser, Rapperswil; Peter Stucki, Tann-Rüti, both of Switzerland

[73] Assignee: Ruti Machinery Works Ltd., Ruti, Switzerland

[21] Appl. No.: 158,373

[22] Filed: Jun. 11, 1980

[30] Foreign Application Priority Data

Jun. 13, 1979 [CH] Switzerland ..... 5522/79

[51] Int. Cl.[3] ..... D03D 47/28

[52] U.S. Cl. ..... 139/435

[58] Field of Search ..... 139/435; 226/97

[56] References Cited

U.S. PATENT DOCUMENTS 3,818,952 6/1974 Vermeulen ..... 139/435

3,958,609 5/1976 Zollinger ..... 139/435

FOREIGN PATENT DOCUMENTS 2918182 11/1980 Fed. Rep. of Germany ..... 139/435

2031033 4/1980 United Kingdom ..... 139/435

2031958 4/1980 United Kingdom ..... 139/435

*Primary Examiner*—Henry Jaudon

*Attorney, Agent, or Firm*—Donald D. Denton

[57] ABSTRACT

A reed for a jet loom, in which the filling yarns are introduced into the shed by a gaseous fluid expelled from nozzles arranged spaced apart over the loom width and which periodically enter the shed, which reed has first reed blades having a profiling on their one edge and together form a guide channel for the filling yarn; and in the region of the projection of the nozzles onto the reed there are provided second reed blades the shape of which at their one edge is so selected that the guide channel is open on the wall thereof adjacent the nozzles.

7 Claims, 2 Drawing Figures

REED FOR JET LOOMS

BACKGROUND OF THE INVENTION

The present invention relates to a reed for a jet loom in which the filling yarns are introduced into the shed by means of a gaseous fluid which is expelled from nozzles which are arranged spaced apart over the loom width and periodically enter into the shed, having first reed blades which have a profiling on their one edge and as a whole form a guide channel for the filling yarns.

In one known reed of this type, the first reed blades are provided on their one edge with two nose-shaped projections between which there is a U-shaped recess. The recesses of all reed blades form the said guide channel. In the practical operation of looms provided with these reeds it has been found that when using as warp yarn certain types of yarn, and particularly difficult man-made filamentary yarns, those warp yarns between which the nozzles penetrate into the shed are subjected to a certain stressing which may possibly be noted in the form of markings in the finished fabric. It has been assumed up to now that this stressing is caused by friction between the warp yarns and the nozzles and, accordingly, attempts have been made to minimize this friction as much as possible by suitable shaping and surface treatment of the nozzles. Nevertheless, the marking of the fabric produced in the case of particularly troublesome yarns could not be reduced to the desired extent.

The closest art known to the applicants is in the disclosure in the U.S. patent to Vermeulen, U.S. Pat. No. 3,818,952.

SUMMARY OF THE INVENTION

By the present invention, the stressing of the warp yarns is reduced at least to such an extent that no marking is visible in the fabric. The invention is based on the new discovery that it is not the nozzles alone which are responsible for the action on the warp yarns but the cooperation of the nozzles with the reed blades adjacent to them.

The invention is characterized by the provision, within the region of the projection of the nozzles onto the reed, of second reed blades which are provided on their one edge with a shaping which differs from the profiling of the first reed blades.

BRIEF DESCRIPTION OF THE DRAWINGS

The invention will be described below with reference to illustrative embodiments and the figures of the drawing, in which.

DESCRIPTION OF PREFERRED EMBODIMENTS

Figure 1:
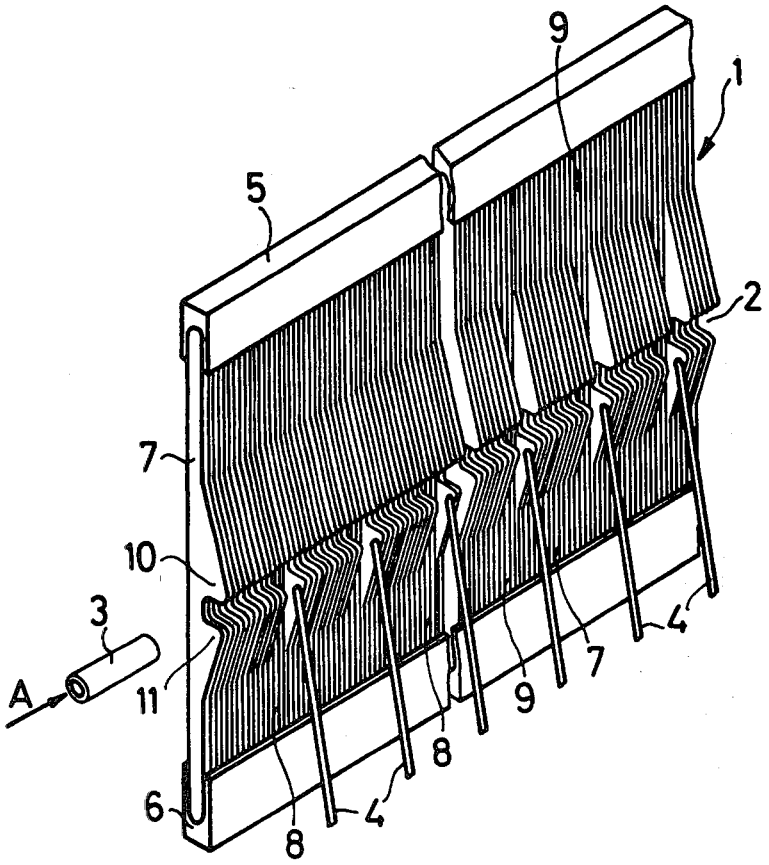
FIG. 1 is a view in perspective showing a portion of a reed with nozzles for the introduction of the filling yarn.

The reed 1 shown in FIG. 1 is intended for use on an air jet loom and has a guide channel 2 for the filling yarns which are to be introduced. The introduction of the filling yarn (not shown) is effected by a main nozzle 3 which is arranged laterally of the warp yarns and through which a filling yarn fed in the feed direction designated by an arrow A is blown into a guide channel 2 produced by a series of reed blades and by auxiliary spaced nozzles 4 which extend close to the guide channel 2 and which are driven in synchronism with the reed 1 and periodically enter into and emerge from the warp yarns. This arrangement of the auxiliary nozzles 4 is known and will not be described in further detail here; reference is had in this connection to U.S. Pat. No. 3,818,952, the disclosure of which is by reference made a part of this application.

The reed 1 consists of an upper and a lower rib 5 and 6, respectively, and of first and second reed blades 7 and 8, 9 respectively, which are held at their ends by the ribs and form guide channel 2. FIG. 1 shows two variants of the reed 1, the first reed blades 7 in both variants having an upper projection 10 and a lower projection 11. In the case of the embodiment shown in the left-hand half of the figure, the second reed blades 8 have an upper projection 10, while the second reed blades 9 of the embodiment shown in the right-hand half of the figure are straight.

Figure 2:
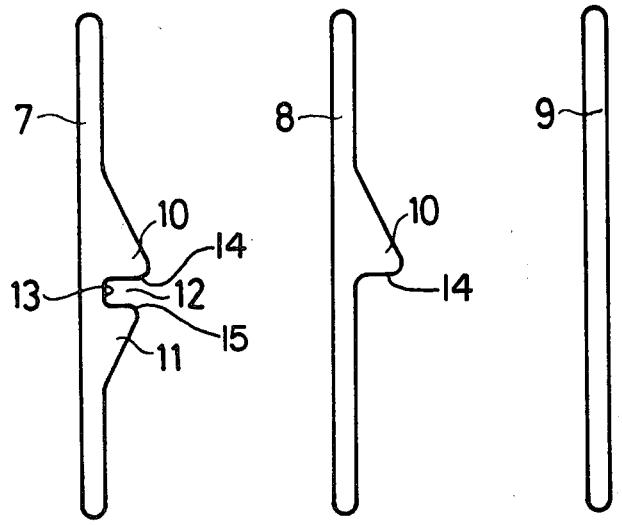
FIG. 2 is a side view of three different reed blades of the reed shown in FIG. 1.

In FIG. 2 there is illustrated the configuration of the first and second reed blades 7 and 8,9, respectively, each shown individually. The projections 10, 11 of the reed blades 7 and 8 are located on the longitudinal edge of the reed blades which, in operation, faces the fell of the cloth. Th inner edges of the projections 10, 11 form the sides 14 and 15 of a U-shaped recess 12, which recesses together form the guide channel 2 of the reed 1. The cross arm 13 of the recesses 12 is aligned with the front edge, facing the fell of the cloth, of the straight second reed blades 9 or with the corresponding straight front edge of the profiled second reed blades 8 which lies below the projection 10. The beating up of the filling is effected by the cross arm 13 of the first reed blades 7 and by the corresponding region of the second reed blades 8 or 9.

The second reed blades 8 and 9 are arranged in the reed 1 in each case at the places of the projection of the auxiliary nozzles 4 on the reed 1, or in other words in the direct vicinity of the tips of the auxiliary nozzles 4. In this way, with the auxiliary nozzles 4 entering into and emerging from the shed, a freer course of the warp yarns between the reed 1 and auxiliary nozzles 4 is assured, due to the absence of the lower projections 11, as a result of which the warp yarns are less strongly stressed by the auxiliary nozzles 4 which are moved relative to them and by the reed 1.

The region having the second reed blades 8 and 9 lies in each case around the tip of the auxiliary nozzles 4; the length of this region is in each case a few millimeters, and preferably about 2 to 3 mm.

In the case of reeds of the type shown in FIG. 1 it is known to form the reed of profiled reed blades of the type of the first reed blades 7 and of straight reed blades of the type of the second reed blades 9, in which connection, for instance, one reed blade of the one type is arranged between two reed blades of the other type. Of course, in the case of the reed 1 of FIG. 1 straight second reed blades 9 or also profiled second reed blades 8 could be arranged outside the regions having the second reed blades 8 or 9, and this could be done with any desired spacing.

Instead of forming the guide channel 2 of reed blades 7 having two projections 10 and 11 and a recess 12, it is also possible to form it of reed blades of the type of the second reed blades 8 having only one projection. In this case, the reed blades would be assembled in such a manner that the projection comes to lie alternately on top and on bottom, whereby a guide channel would also result. In this case also, straight reed blades could be arranged between the profiled blades. In the regions of the reed adjacent the tips of the auxiliary nozzles 4 there would be arranged in this case also only second reed blades 8 or 9, in which connection in this case also, in the same way as in all other applications, both types of second blades 8, 9 could also be provided mixed in the said regions.

It is essential in all cases that the guide channel 2 be open at least at its wall adjacent the auxiliary nozzles 4 within the region of the auxiliary nozzles 4. This wall need not be the lower wall as shown in the figures but, if the auxiliary nozzles extend into the warp yarns from above, it could also be the upper wall.

Although the invention is described in detail for the purpose of illustration, it is to be understood that such detail is solely for that purpose and that variations can be made therein by those skilled in the art without departing from the spirit and scope of the invention except as it may be limited by the claims.

What is claimed is:

1. A reed for a jet loom in which the filling yarns are introduced into the shed by means of a gaseous fluid which is expelled by nozzles arranged, spaced apart from each other, over the loom width which periodically enter into the shed; having first reed blades having a profiling with a recess on their one edge, the said recesses forming as a whole a guide channel for the filling yarns, characterized by the fact that in the region of the projection of the nozzles onto the reed there are provided second reed blades which on their one edge have a shape which differs from the profiling of the first reed blades.

2. A reed according to claim 1 wherein the said recess of each first reed blade has a U-shaped configuration and is bounded at its lower and upper edge by a lower and upper projection respectively and wherein, in the case of the nozzles entering into the shed from below, the second reed blades have an upper projection only and are open on the lower side wall of the guide channel.

3. A reed according to claim 1 wherein the shaping of the one edge of the second reed blades is so selected that the guide channel is open at least on a side wall of the reed blades adjacent the nozzles.

4. A reed according to claim 3 wherein the second reed blades are provided on their one edge with a projection which limits the guide channel on the side wall thereof furthest from the nozzles.

5. A reed according to claim 4 wherein, in the case of the nozzles which enter into the shed from below, the projection defines the top of the guide channel.

6. A reed according to claim 3 wherein the second reed blades are straight on their one edge facing the fell of the cloth.

7. A reed according to claim 1 wherein said second reed blades are an arrangement of ones having a single projection and ones having a straight edge arranged in the said regions of the reed facing the fell of the cloth.

* * * * *